US010088218B2

(12) United States Patent
Hu et al.

(10) Patent No.: US 10,088,218 B2
(45) Date of Patent: Oct. 2, 2018

(54) REFRIGERATOR AND CONTROL METHOD THEREOF

(71) Applicant: LG ELECTRONICS INC., Seoul (KR)

(72) Inventors: Jinseok Hu, Seoul (KR); Namhun Kim, Seoul (KR); Youngdoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 171 days.

(21) Appl. No.: 15/090,313

(22) Filed: Apr. 4, 2016

(65) Prior Publication Data

US 2017/0059228 A1 Mar. 2, 2017

(30) Foreign Application Priority Data

Sep. 2, 2015 (KR) ..... 10-2015-0124501
Sep. 2, 2015 (KR) ..... 10-2015-0124502

(51) Int. Cl.
*F25D 17/04* (2006.01)
*F25D 17/06* (2006.01)
(Continued)

(52) U.S. Cl.
CPC ..... *F25D 17/065* (2013.01); *F25B 13/00* (2013.01); *F25B 49/02* (2013.01); *F25D 17/045* (2013.01); *F25D 17/04* (2013.01); *F25D 2317/0651* (2013.01); *F25D 2317/0653* (2013.01); *F25D 2317/0663* (2013.01);
(Continued)

(58) Field of Classification Search
CPC ..... F25D 17/065; F25D 17/045; F25D 2317/0651; F25D 2700/12; F25D 2700/122; F25B 13/00
See application file for complete search history.

(56) References Cited

U.S. PATENT DOCUMENTS 4,852,361 A * 8/1989 Oike ..... F25D 17/045 62/131
6,176,097 B1 1/2001 Kim
(Continued)

FOREIGN PATENT DOCUMENTS

CN 101004311 A 7/2007
CN 103968633 A 8/2014
(Continued)

*Primary Examiner* — Larry Furdge
(74) *Attorney, Agent, or Firm* — Dentons US LLP

(57) ABSTRACT

A refrigerator and a method of control thereof, whereby after driving of a compressor and a blower fan is stopped as temperatures of a refrigeration compartment and a freezer compartment are in a satisfactory state, opening/closing operations of a damper are repeatedly performed, so that cold air in the freezer compartment is supplied into the refrigeration compartment. Alternatively, if the temperature of the refrigeration compartment reaches an upper limit temperature, the repeated opening/closing operations of the damper are started. The repeated opening/closing operations of the damper are performed until the temperature of the refrigeration compartment reaches a lower limit temperature, so that a cooling operation of the refrigeration compartment is performed only once while the compressor is being driven.

14 Claims, 7 Drawing Sheets

(51) Int. Cl.
*F25B 13/00* (2006.01)
*F25B 49/02* (2006.01)

(52) U.S. Cl.
CPC .. *F25D 2317/0665* (2013.01); *F25D 2400/06* (2013.01); *F25D 2700/12* (2013.01); *F25D 2700/122* (2013.01)

(56) References Cited

U.S. PATENT DOCUMENTS

| | | | | |
|---|---|---|---|---|
| 6,327,867 | B1 * | 12/2001 | Hyodo | F25B 5/04 62/187 |
| 2003/0188547 | A1 * | 10/2003 | Jeon | F25D 17/045 62/408 |
| 2007/0163291 | A1 * | 7/2007 | Kim | F25D 17/065 62/408 |
| 2010/0236269 | A1 * | 9/2010 | Mamemoto | A23B 7/0425 62/331 |

FOREIGN PATENT DOCUMENTS

| | | | |
|---|---|---|---|
| GB | 2201014 | A | 8/1988 |
| JP | 62-049174 | | 3/1987 |
| JP | H0282077 | A | 3/1990 |
| KR | 10-2004-0048771 | A | 6/2004 |
| KR | 10-2014-0097860 | A | 8/2014 |

* cited by examiner

REFRIGERATOR AND CONTROL METHOD THEREOF

CROSS-REFERENCE TO RELATED APPLICATIONS

This application claims the benefits of priority to Korean Patent Application No. 10-2015-0124501 filed on Sep. 2, 2015 and Korean Patent Application No. 10-2015-0124502 filed on Sep. 2, 2015, the disclosures of which are incorporated herein by reference.

BACKGROUND

1. Field of the Invention

The present disclosure relates to a refrigerator and a control method thereof.

2. Description of the Related Art

In general, refrigerators are home appliances for storing foods at a low temperature in a storage space covered by a door. For this, such a refrigerator cools a storage space using cold air generated through heat-exchange with a refrigerant circulating in a refrigeration cycle, so that foods stored in the storage space can be kept in a refrigeration or frozen state.

The temperature of a storage space should be maintained at a set temperature such that foods stored in the storage space are always kept in an optimal state. In addition, the interior of the storage space should be sealed to maintain the set temperature, and should be continuously cooled through the supply of cold air using a refrigeration cycle.

For example, Korean Patent Laid-open Publication No. 1997-0070868 discloses a refrigerator in which a storage space is divided into a refrigeration compartment and a freezer compartment, and the freezer compartment is maintained at a set temperature by cold air generated by an evaporator provided at the rear side of the freezer compartment. In the refrigerator, a damper is provided on a flow path of cold air supplied into the refrigeration compartment, and the amount of the cold air supplied into the refrigeration compartment is adjusted by opening/closing the damper, so that the refrigeration compartment is maintained at a set temperature.

However, in the configuration described above, if driving of a compressor is started, the damper is opened such that the refrigeration compartment and the freezer compartment are cooled at the same time. Then, if the damper is closed as the operation of the refrigeration compartment having a relatively high set temperature is first completed, the freezer compartment is continuously cooled. If the operation for cooling the freezer compartment is continued for a long period of time, the temperature of the refrigeration compartment may be increased to the set temperature or higher. Then, the damper is opened to re-cool the refrigeration compartment.

Under the circumferences, the refrigeration compartment can be re-cooled, but the temperature of the freezer compartment may be again increased as high-temperature air is introduced from the refrigeration compartment into the freezer compartment. As a result, it takes longer to operate the compressor. In other words, although the temperature of the refrigeration compartment is again decreased to the set temperature or lower, it takes longer for the compressor to cool the freezer compartment. Additionally, power consumption is also increased.

SUMMARY

Embodiments provide a control method of a refrigerator, in which, in a state in which a compressor is stopped as a cooling operation of a freezer compartment is ended, a damper installed in a cold air flow path connecting a refrigeration compartment and the freezer compartment to each other is repeatedly opened/closed, so that cold air of the freezer compartment can be supplied into the refrigeration compartment through natural convection.

Embodiments also provide a control method of a refrigerator, in which a point of time when a cooling operation of a refrigeration compartment is ended is delayed, so that the cooling operation of the refrigeration compartment can be performed only once while a compressor for cooling a freezer compartment is being driven.

Embodiments also provide a control method of a refrigerator, in which, when a cooling operation of a refrigeration compartment is performed twice or more while a compressor is being driven, a point of time when a next cooling operation of the refrigeration compartment is to be ended is delayed, so that the cooling operation of the refrigeration compartment can be performed only once while the compressor is being driven.

According to an embodiment of the disclosure, there is provided a refrigerator comprising a cabinet forming a storage space, a barrier partitioning the storage space into a refrigeration compartment and a freezer compartment, the barrier having a supply duct and a return duct formed at separate portions thereof to connect the refrigeration compartment with the freezer compartment, a compressor compressing a refrigerant, an evaporator cooling cold air in the storage space, a blower fan supplying the cold air generated by the evaporator into the freezer compartment, a damper that opens and closes the supply duct, and a controller controlling driving of the compressor, the blower fan, and the damper, wherein the controller controls the driving of the compressor and the blower fan to stop when temperatures of the refrigeration compartment and the freezer compartment are both in a satisfactory state and then controls the opening/closing operations of the damper to repeatedly perform so that cold air in the freezer compartment is supplied into the refrigeration compartment through the supply duct.

According to another embodiment of the disclosure, there is provided a refrigerator comprising a cabinet forming a storage space, a barrier partitioning the storage space into a refrigeration compartment and a freezer compartment, the barrier having a supply duct and a return duct formed at separate portions thereof to connect the refrigeration compartment with the freezer compartment, a compressor compressing a refrigerant, an evaporator cooling cold air in the storage space, a blower fan supplying the cold air generated by the evaporator into the freezer compartment, a damper that opens and closes the supply duct, and a controller controlling driving of the compressor, the blower fan, and the damper, wherein, when a temperature of the refrigeration compartment reaches an upper limit temperature, the controller controls the damper to repeatedly open and close until the temperature of the refrigeration compartment reaches a lower limit temperature.

It is to be understood that both the foregoing general description and the following detailed description of the present disclosure are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

Reference will now be made in detail to the preferred embodiments of the present disclosure, examples of which are illustrated in the accompanying drawings. Advantages, features, and methods for achieving those of embodiments may become apparent upon referring to embodiments described later in detail together with the attached drawings. However, embodiments are not limited to the embodiments disclosed hereinafter, but may be embodied in different modes. The same reference numbers may refer to the same elements throughout the specification.

For convenience of illustration and understanding, a side-by-side type refrigerator in which a refrigeration compartment and a freezer compartment are disposed side by side is described as an example. However, it is understood that the present disclosure is applicable to all types of refrigerators, each enabling cold air to be supplied into a refrigeration compartment by opening/closing a damper.

Figure 1:
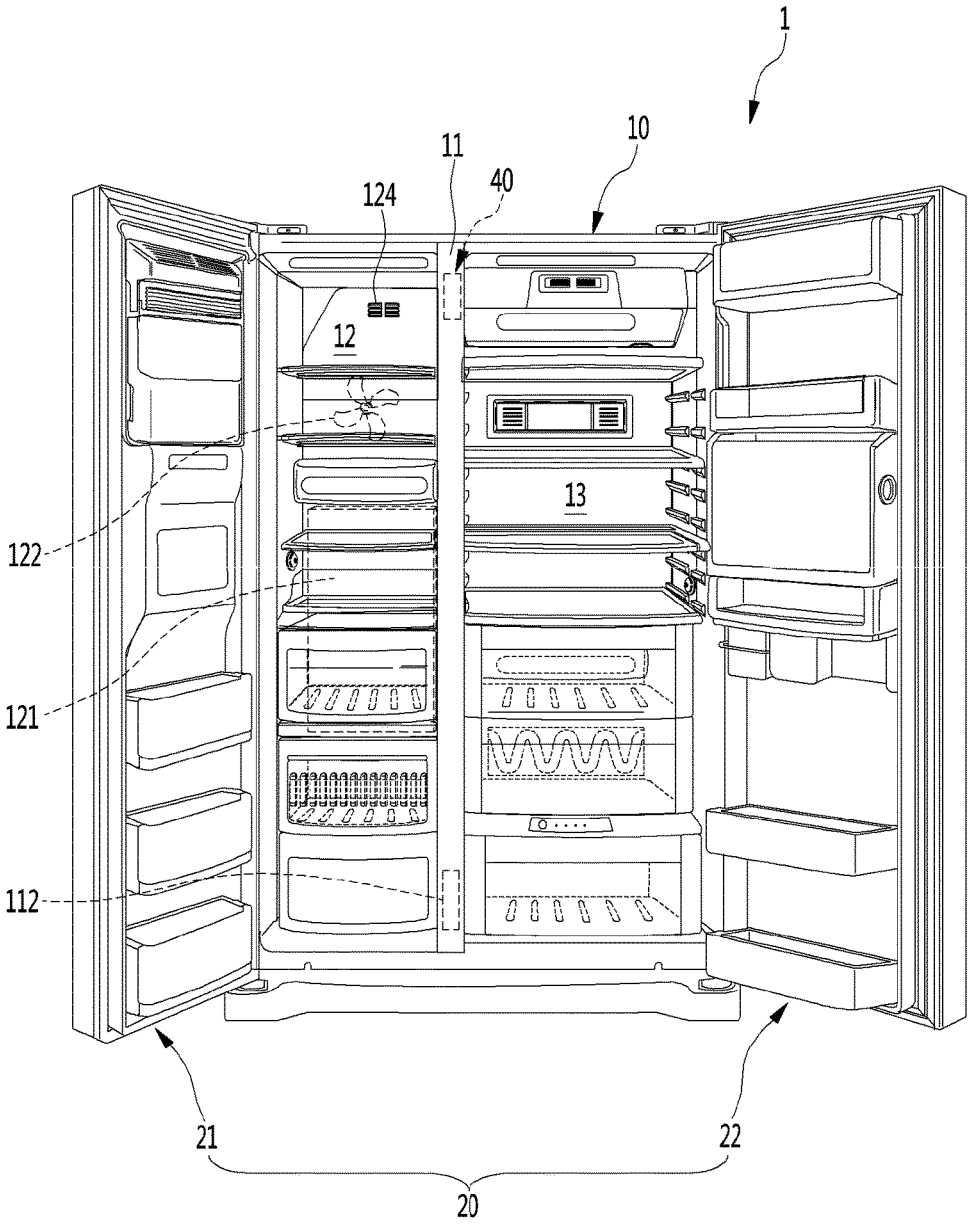
FIG. 1 is a diagram illustrating a schematic configuration of a refrigerator according to an embodiment of the disclosure.
Figure 2:
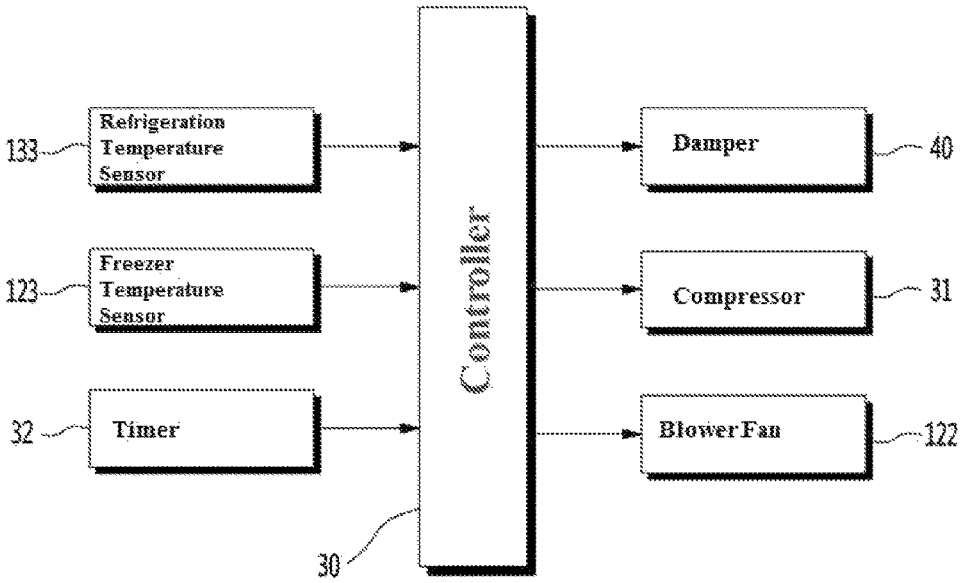
FIG. 2 is a block diagram illustrating a control signal flow of the refrigerator.
Figure 3:
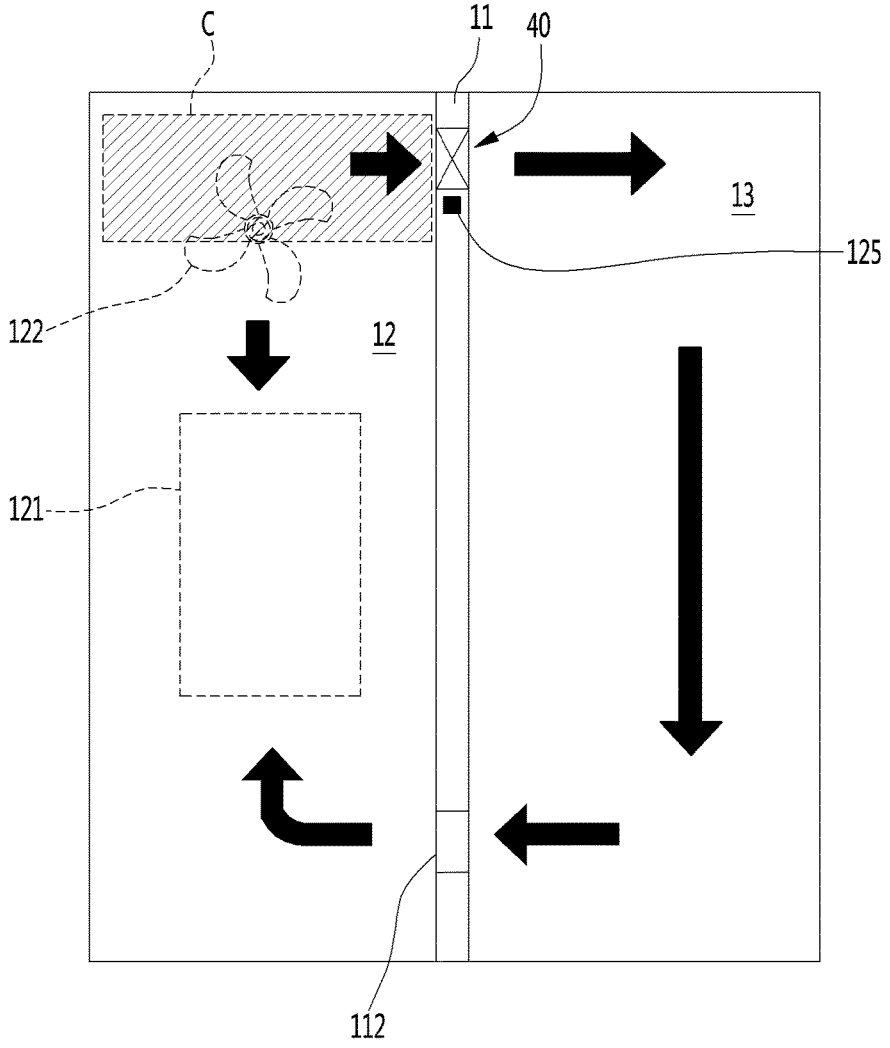
FIG. 3 is a diagram schematically illustrating a cold air circulation state of the refrigerator.

FIG. 1 is a diagram illustrating a schematic configuration of a refrigerator according to an embodiment of the disclosure. FIG. 2 is a block diagram illustrating a control signal flow of the refrigerator. FIG. 3 is a diagram schematically illustrating a cold air circulation state of the refrigerator.

Referring to FIGS. 1 to 3, the refrigerator 1 according to the embodiment may include a cabinet 10 forming a storage space therein and a door 20 opening/closing the storage space.

The storage space may include a freezer compartment 12 and a refrigeration compartment, which are partitioned as both left and right sides by a barrier 11. In addition, the door 20 may include a freezer compartment door 21 opening/closing the freezer compartment 12 and a refrigeration compartment door 22 opening/closing the refrigeration compartment 13. The freezer compartment door 21 and the refrigeration compartment door 22 may rotate in directions opposite to each other, to open/close the freezer compartment 12 and the refrigeration compartment 13, respectively.

A plurality of drawers, shelves, and the like may be provided inside each of the freezer compartment 12 and the refrigeration compartment 13. A basket for storing foods may be provided at a rear surface of each of the freezer compartment door 21 and the refrigeration compartment door 22. The freezer compartment door 21 may be provided with an ice maker for making ice, an ice bin for storing the ice made by the ice maker, and a dispenser communicating with the ice bin through a discharge duct (not shown) formed inside the freezer compartment door 21, the dispenser enabling the ice stored in the ice bin to be extracted to the exterior of the refrigerator 1. The refrigeration compartment door 22 may be provided with a home-bar structure.

Meanwhile, although not shown in detail in FIG. 1, a machinery room partitioned from the storage space may be provided at a lower end of a rear portion of the cabinet 10. Components constituting a refrigeration cycle may also be provided inside the machinery room. For example, a compressor 31, a condenser, and a condenser fan may be provided inside the machinery room.

An evaporating room (not shown) may be formed at the rear of the freezer compartment 12, and an evaporator 121 may be provided in the evaporating room. In addition, a blower fan 122 may be provided above the evaporator 121, to allow cold air generated by the evaporator 121 to be introduced into the freezer compartment 12 or the refrigeration compartment 13. The evaporator 121 and the blower fan 122 may be covered by a grille pan forming a rear surface of the freezer compartment 12.

One or more cold air discharge holes 124 may be formed in the grille pan, such that the cold air generated by the evaporator 121 may be supplied into the freezer compartment 12. In addition, the discharge hole 124 may be provided at an upper portion of the grille pan, specifically an upper portion of the freezer compartment 12. Such configuration enables cold air supplied to the freezer compartment 12 by rotating the blower fan 122 to be directed downward to more uniformly cool the temperature of the freezer compartment 12.

The barrier 11 partitions the storage space formed inside the cabinet 10 into the freezer compartment 12 and the refrigeration compartment 13. In addition, a supply duct (not shown) flexibly connecting the freezer compartment 12 and the refrigeration compartment 13 to each other may be provided at an upper portion of the barrier 11, and a damper 40 may be provided in the supply duct, to selectively open/close the supply duct.

For example, when the damper 40 is open, a portion of the cold air supplied into the freezer compartment 12 through the discharge hole 124 may be supplied into the refrigeration compartment 13 by passing through the supply duct. A return duct (not shown) may be provided at a lower portion of the barrier 11 to allow air inside the refrigeration compartment 13 to be introduced into the freezer compartment 12.

Meanwhile, the damper 40 may be provided at a position lower than the height of the discharge hole 124 formed in the rear surface of the freezer compartment 12. Such configuration enables cold air at an upper portion of the freezer compartment 12 to be introduced into the refrigeration compartment 13 through natural convection simply by opening the damper 40.

A freezer compartment temperature sensor 123 and a refrigeration compartment temperature sensor 133 may be provided inside the freezer compartment 12 and the refrigeration compartment 13, respectively, so that temperatures of the freezer compartment 12 and the refrigeration compartment 13 can be sensed or monitored in real time. In addition, whether to drive the refrigeration cycle and a time required to drive the refrigeration cycle may be determined based on the temperatures respectively sensed by the temperature sensors 123 and 133.

For example, when the temperature inside the freezer compartment 12 is sensed as greater than or equal to a set temperature, the compressor 31 and the blower fan 122 may be driven to supply cold air inside the evaporating room, cooled by the evaporator 121, into the freezer compartment 12, so that the temperature of the freezer compartment 12 can be in a satisfactory state.

Also, when the temperature inside the refrigeration compartment 13 is sensed as greater than or equal to a set temperature, the compressor 31 and the blower fan 122 are driven, and simultaneously, the damper 40 is opened. A portion of the cold air supplied into the freezer compartment 12 is then supplied into the refrigeration compartment 13, so that the temperature of the refrigeration compartment 13 can be in a satisfactory state.

Meanwhile, the refrigeration compartment 13 may be cooled down to the set temperature by the cold air supplied into the refrigeration compartment 13 through opening of the damper 40, and air inside the refrigeration compartment 13 may be returned into the freezer compartment 12 through the return duct 112.

A controller 30 determines opening/closing of the supply duct by controlling driving of the damper 40 such that the refrigeration compartment 13 can be selectively cooled by controlling the driving of the damper 40.

For example, if it is determined that a refrigeration compartment temperature value transmitted from the refrigeration compartment temperature sensor 133 is in a dissatisfactory state, e.g., the temperature inside the refrigeration compartment 13 is greater than or equal to the set temperature, the controller 30 may open the damper 40 such that the refrigeration compartment 13 can be cooled. However, if it is determined that the refrigeration compartment temperature value transmitted from the refrigeration compartment temperature sensor 133 is in a satisfactory state, e.g., the temperature inside the refrigeration compartment 13 is less than or equal to the set temperature, the controller 30 closes the damper 40.

Meanwhile, if the operation of the compressor 31 is stopped in a condition in which the temperature of the refrigeration compartment 13 is in the satisfactory state, the controller 30 may repeat opening/closing operations of the damper 40 in a set period such that a portion of the cold air of the freezer compartment 12 can be introduced into the refrigeration compartment 13.

The damper 40 in its closed state may be frozen by cold air of the evaporator 121. Therefore, a heater 125 may be provided at one side of the damper 40 to heat the damper 40 so that the damper 40 may normally operate without being attached to the barrier 11. The heater 125 continuously operates due to driving characteristics of the damper 40, but may maintain a turn-off state (section B in FIG. 4) when the damper 40 is periodically turned on/off. The reference number 32 which has not been referred is a timer.

Figure 4:
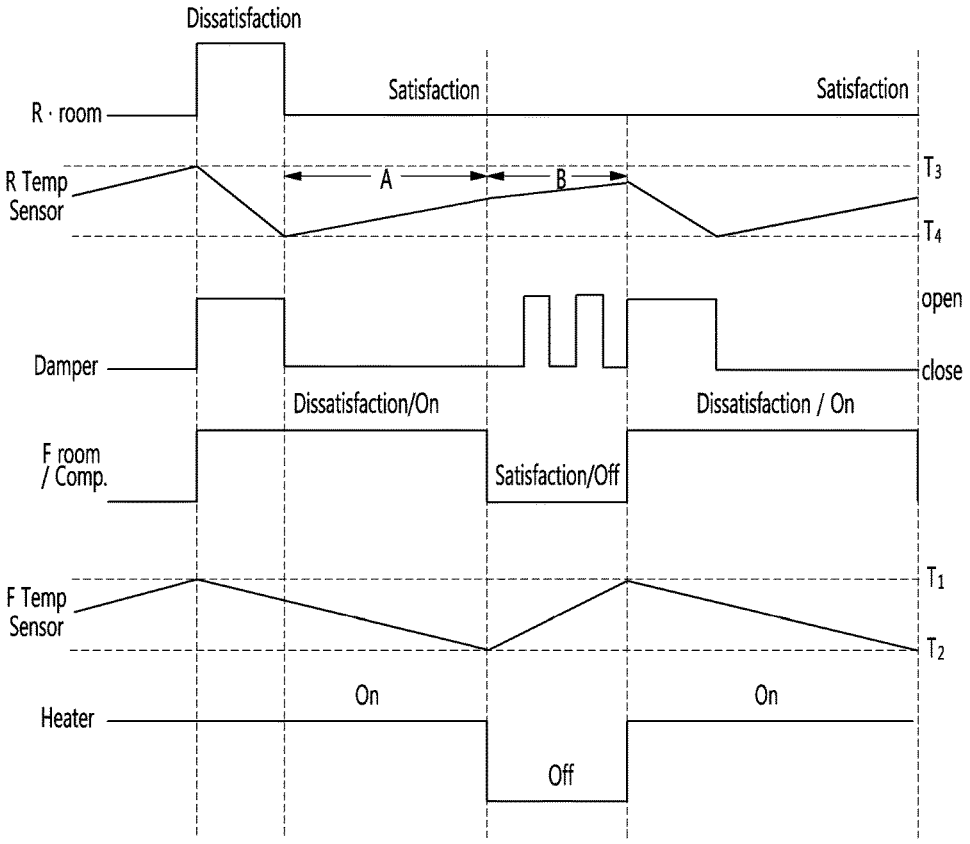
FIG. 4 is a graph illustrating a change in operation state of the refrigerator performed by a control method of the refrigerator according to a first embodiment of the disclosure.

FIG. 4 is a graph illustrating a change in operation state of the refrigerator performed by a control method of the refrigerator according to a first embodiment of the disclosure.

Referring to FIG. 4, the refrigeration compartment temperature sensor 133 (R Temp Sensor) and the freezer compartment temperature sensor 132 (F Temp Sensor) sense temperatures of the refrigeration compartment 13 and the freezer compartment 12, respectively. In addition, the controller 30 controls driving of the compressor 31 and the damper 40, based on the temperatures respectively sensed by the temperature sensors 123 and 133, so that the refrigeration compartment 13 and the freezer compartment 12 are maintained within a set temperature range.

For example, if the freezer compartment temperature sensor 123 senses that the temperature of the freezer compartment 12 has reached an upper limit temperature $T_1$, the temperature of the freezer compartment 12 is determined to be in a dissatisfactory state, and the compressor 31 is driven. As the compressor 31 is driven, the refrigeration cycle is activated, and the evaporator 121 generates cold air. The generated cold air is supplied into the freezer compartment 12 by the blower fan 122, so that the freezer compartment 12 is cooled. As the compressor 31 is driven, the freezer compartment 12 is continuously cooled.

However, for example, if the freezer compartment temperature sensor 123 senses that the temperature of the freezer compartment 12 has reached a lower limit temperature $T_2$, the temperature of the freezer compartment 12 is determined to be in a satisfactory state, and the driving of the compressor 31 is stopped.

As described above, the driving of the compressor 31 is determined based on the temperature of the freezer compartment 12, so that the freezer compartment 12 can be maintained at a set temperature or lower.

Meanwhile, as the damper 40 is driven, the cold air generated by the evaporator 121 is supplied into the refrigeration compartment 13 via the freezer compartment 12, so that the refrigeration compartment 13 can be cooled to a set temperature.

However, for example, if the refrigeration compartment temperature sensor 133 senses that the temperature of the refrigeration compartment 13 has reached an upper limit temperature $T_3$, the temperature of the refrigeration compartment 13 is determined to be in a dissatisfactory state. The damper 40 is then opened to cool the refrigeration compartment 13, and a portion of the cold air is introduced into the freezer compartment 12 from the evaporating room in which the evaporator 121 is provided.

The damper 40 may be opened with the driving of the compressor 31, regardless of the state of the refrigeration compartment 13, such that the cold air of the freezer compartment 12 can be supplied into the refrigeration compartment 13. Thus, if the temperature of the refrigeration compartment 13 is in a dissatisfactory state when the driving of the compressor 31 is started, the refrigeration compartment 13 is cooled by the cold air of the freezer compartment 12, which is supplied into the refrigeration compartment 13.

On the other hand, although the temperature of the refrigeration compartment 13 is in a satisfactory state when the driving of the compressor 31 is started, the refrigeration compartment 13 is cooled close to a lower limit temperature $T_4$ by the cold air of the freezer compartment 12, and thus the frequency in the case where the temperature of the refrigeration compartment 13 is in a dissatisfactory state is decreased. It is understood, for example, that when the driving of the compressor 31 is started, it is highly likely that the temperature of the refrigeration compartment 13 will be at a temperature that is close to the upper limit temperature $T_3$ even though the temperature of the refrigeration compartment 13 is in a satisfactory state. Accordingly, the damper 40 is opened regardless of the state of the refrigeration compartment 13.

The cold air circulating inside the refrigeration compartment 13 is returned into the freezer compartment 12 through the return duct 112. The cold air returned into the freezer compartment 12 through the return duct 112 is suctioned into the evaporating room, to be re-cooled through heat-exchange with the evaporator 121.

The damper 40 maintains an open state until the temperature of the refrigeration compartment 13, which is sensed by the refrigeration compartment temperature sensor 133, reaches the lower limit temperature $T_4$ such that the cold air generated by the evaporator 121 can be supplied into the refrigeration compartment 12. For example, if the temperature of the refrigeration compartment 13 reaches the lower limit temperature $T_4$, the damper 40 is closed and a cooling operation of the refrigeration compartment 13 is ended.

Meanwhile, because the lower limit temperature $T_4$ of the refrigeration compartment 13 is greater than the lower limit temperature $T_2$ of the freezer compartment 12, the cooling time of the refrigeration compartment 13 is less than the cooling time of the freezer compartment 12. When a cooling operation of the freezer compartment 12 is ended and then restarted, the compressor 31 and the blower fan 122 are re-driven, and the damper 40 may be opened such that a cooling operation of the refrigeration compartment 13 can be started together with the cooling operation of the freezer compartment 12.

Here, before the cooling operation of the refrigeration compartment 13 is started as the compressor 31 and the blower fan 122 are driven, the damper 40 repeats opening/closing operations such that cold air of the freezer compartment 12 is supplied into the refrigeration compartment 13 through natural convection. Thus, a satisfactory state of the refrigeration compartment 13 can be extended, which reduces power consumption by delaying when the compressor 31 and the blower fan 122 are driven.

Specifically, if the cooling operation of the freezer compartment 12 is ended, the driving of the compressor 31 and the blower fan 122 is stopped. In this state, the opening/closing operations of the damper 40 may be periodically repeated after a set time elapses. That is, the repeated opening/closing operations of the damper 40 may be started at a point of time when the set time elapses from the point of time when the driving of the compressor 31 is stopped regardless of the temperature of the refrigeration compartment 13.

Alternatively, the point of time when the repeated opening/closing operations is started may be a point of time when it is determined that the temperature of the refrigeration compartment 13 has been increased up to a set temperature between the lower limit time $T_4$ and the upper limit temperature $T_3$. The set temperature may be an intermediate value of the upper limit value $T_3$ and the lower limit value $T_4$, but the temperature at which the opening/closing operations of the damper 40 are started may be set differently when necessary.

It is also understood that the opening/closing operations of the damper 40 are not limited to being started from the moment when the driving of the compressor 31 and the blower fan 122 is stopped.

If the set time elapses in the state in which the driving of the compressor 31 and the blower fan 122 is stopped, or if the temperature of the refrigeration compartment 13 reaches the set temperature, the damper 40 may repeat the opening/closing operations at an interval of a predetermined time.

In addition, the opening/closing operations of the damper 40 may be continued up to the point of time when the compressor 31 is to be driven as the temperature of the freezer compartment 12 is in a satisfactory state. Alternatively, the opening/closing operations of the damper 40 may be continued during only the set time.

If the compressor 31 is driven to cool the freezer compartment 12, the damper 40 maintains its open state, and closes if the temperature of the refrigeration compartment 13 is decreased to the lower limit temperature $T_4$. As a result, a continuous opening operation of the damper 40 is performed only once while the compressor 31 is being driven, and the cold air of the freezer compartment 12 is supplied into the refrigeration compartment 13. Thus, the cooling time of the refrigeration compartment 13 can be decreased. Also, the driving time of the compressor 31 can be decreased.

Meanwhile, in a situation in which the opening/closing operations of the damper 40 are repeated, it is unlikely that the damper 40 will be frozen due to its opening/closing operations. Therefore, the heater 125 may be controlled to maintain the turn-off state. In addition, the heater 125 is turned on at the same time when the compressor 31 and the blower fan 122 are driven, so that the turn-on state of the heater 125 can be maintained until the opening/closing operations of the damper 40 are started.

As shown in FIG. 3, cold air generated by the evaporator 121 may be supplied into the freezer compartment 12 and the refrigeration compartment 13 by rotating the blower fan 122, and the freezer compartment 12 and the refrigeration compartment 13 may be cooled by the cold air forcibly blown by the blower fan 122. Accordingly, a portion of the cold air supplied into the freezer compartment 12 by the blower fan 122 is circulated inside the freezer compartment 12, and another portion of the cold air may be supplied into the refrigeration compartment 13 by opening the damper 40. It is understood that a portion of the cold air supplied into the refrigeration compartment 13 may be air that has been circulated inside the freezer compartment 12, but a major portion of the cold air is the cold air supplied from the evaporator 121.

The freezer compartment 12 and the refrigeration compartment 13 may be selectively cooled by opening/closing the damper 40. In addition, the cold air introduced into the refrigeration compartment 13 in the opening of the damper 40 may be returned into the freezer compartment 12 through the return duct 112 such that the continuous circulation of the cold air is possible.

Moreover, in an embodiment where the discharge hole 124 formed in the grille pan of the freezer compartment 12 is positioned at the upper portion of the freezer compartment 12, air at an upper portion (area C of FIG. 3) of the freezer compartment 12 is cooler than air at a lower portion of the freezer compartment 12. In this configuration, if the damper 40 is opened, cold air at the upper portion of the freezer compartment 12 may be introduced into the refrigeration compartment 13 through natural convection. In addition, the cold air introduced into the refrigeration compartment 13 cools the refrigeration compartment 13.

In the state in which the driving of the compressor 31 and the blower fan 122 is stopped, cold air circulated inside the freezer compartment 13 may be introduced into the refrigeration compartment 13. In such configuration, the temperature of the cold air supplied into the refrigeration compartment 13 after the driving of the compressor 31 and the blower fan 122 is stopped is higher than the temperature of the cold air supplied from the evaporator 141 but lower than the temperature of the cold air of the refrigeration compartment 13. Hence, the refrigeration compartment 13 can be more sufficiently cooled.

Thus, as shown in FIG. 4, the increasing rate of the temperature inside the refrigeration compartment 13 at section B where the damper 40 repeats opening/closing operations is less than the increasing rate of the temperature inside the refrigeration compartment 13 at section A where the damper 40 is maintained in its closed state. This means that the repeated opening/closing operations of the damper 40 suppress an increase in temperature of the refrigeration compartment 13. Accordingly, the time for which the temperature of the refrigeration compartment 13 is maintained in the satisfactory state can be increased, and the point of time when the compressor 31 is driven can be delayed, thereby reducing power consumption.

Meanwhile, the compressor 31 may be driven as the point of time when the temperature of the freezer compartment 12 is in the dissatisfactory state is reached earlier than the point of time when the temperature of the refrigeration compartment 13 is in the dissatisfactory state due to the repeated opening/closing operations of the damper 40. Thus, because the temperature of the refrigeration compartment 13 is lower than the upper limit temperature $T_3$ as described above, the time required to cool the refrigeration compartment 13 can be shortened, and the time required to drive the compressor 31 can be relatively shortened, thereby reducing power consumption.

Meanwhile, cold air having a relatively low temperature, which is concentrated on the upper portion of the freezer compartment 12, can be dispersed toward the refrigeration compartment 13, and thus a uniform temperature distribution can be entirely formed inside the freezer compartment 12.

The opening/closing period of the damper 40 may also be adjusted based on an amount of cold air distributed at the upper portion of the freezer compartment 12. Also, the opening/closing period of the damper 40 may be determined within a range where the cooling operation period of the freezer compartment 12 is not reduced even when the temperature of the freezer compartment 12 is increased.

Figure 5:
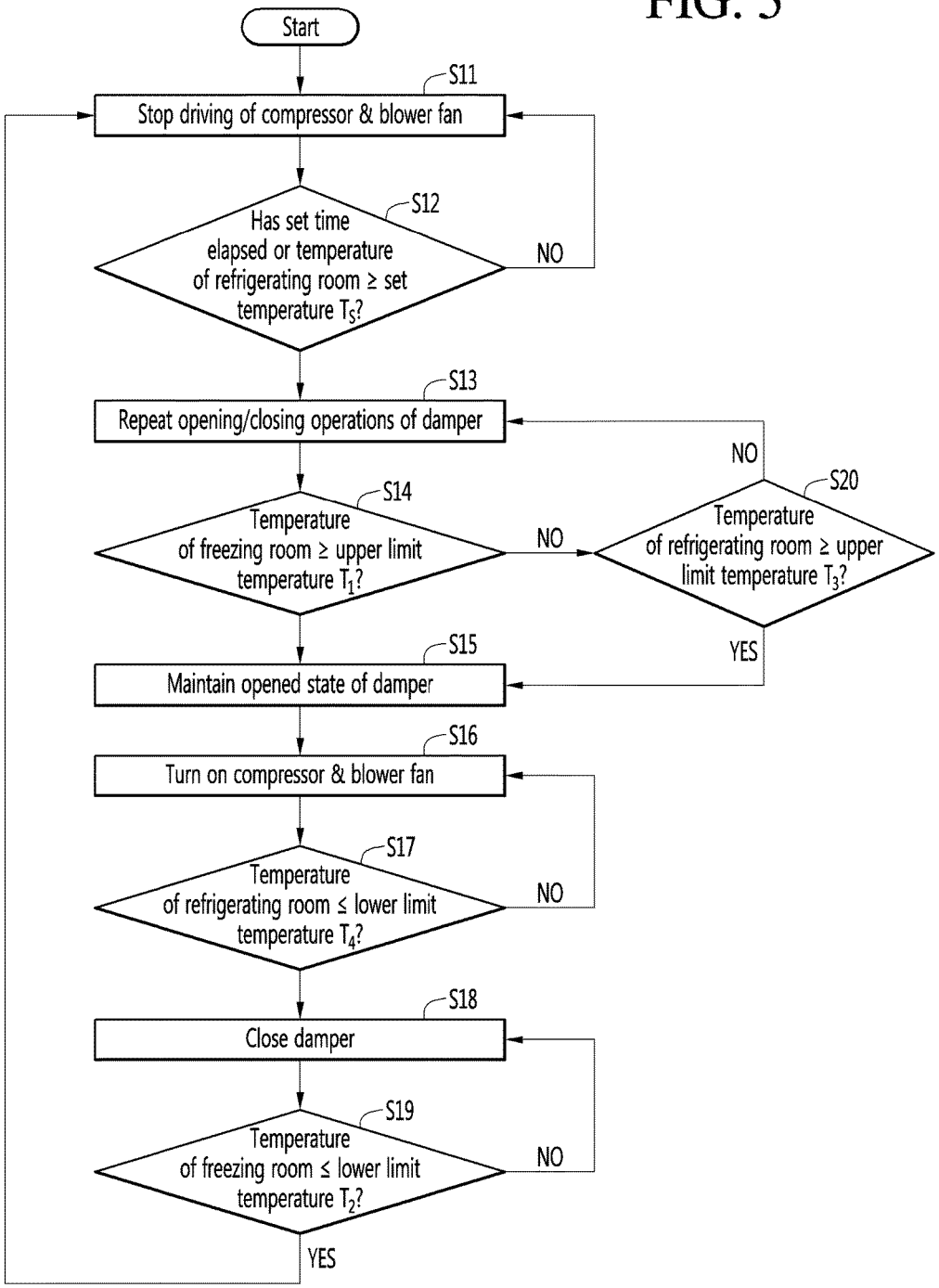
FIG. 5 is a flowchart illustrating the control method according to the first embodiment.

FIG. 5 is a flowchart illustrating the control method according to the first embodiment. As shown in FIG. 5, the control method is started in a state when the driving of the compressor 31 and the blower fan 122 is stopped as each of the refrigeration compartment 13 and the freezer compartment 12 reaches the lower limit temperature (S11).

If it is determined that a set time has elapsed from the point of time when the driving of the compressor 31 and the blower fan 122 is stopped or that the temperature of the refrigeration compartment 13 has been increased to a set temperature $T_S$ between the upper limit temperature and the lower limit temperature (S12), the repeated opening/closing operations of the damper 40 are started (S13).

Then, it is determined whether the temperature of the freezer compartment 12 is greater than or equal to the upper limit temperature $T_1$ (S14). If it is determined that the temperature of the freezer compartment 12 has reached the upper limit temperature $T_1$, the opened state of the damper 40 is maintained (S15), and the compressor 31 and the blower fan 122 are driven (S16).

Here, there may occur a situation where the temperature of the refrigeration compartment 13 first reaches the upper limit temperature $T_3$ as compared with the freezer compartment 12 while the repeated opening/closing operations of the damper 40 are being performed (S20). For example, a load increase as food is put into the refrigeration compartment 12 even though the repeated opening/closing operations of the damper are performed. In this situation, the opened state of the damper 40 may be maintained even before the temperature of the freezer compartment 12 reaches the upper limit temperature $T_1$.

Next, if it is determined that the temperature of the refrigeration compartment 13 has reached the lower limit temperature T4 as the supply of cold air into the refrigeration compartment 13 is continuously performed (S17), the damper 40 is closed (S18).

Next, if it is determined that the temperature of the freezer compartment 12 has reached the lower limit temperature $T_2$ (S19), the control method returns to step S11 in which the driving of the compressor 31 and the blower fan 122 is stopped, and the above described control method is repeated.

Features of the control method according to non-limiting embodiments of the disclosure will be described. If the driving of the compressor is started to cool the freezer compartment, the damper is opened. In this state, the opened state of the damper is maintained until the temperature of the refrigeration compartment reaches the lower limit temperature. Thus, the temperature of the refrigeration compartment is decreased to the lower limit temperature. In addition, when the set time elapses after the damper is closed or when the temperature of the refrigeration compartment is again increased up to the set temperature, the opening/closing operations of the damper are repeated such that the point of time when the temperature of the refrigeration compartment reaches the upper limit time $T_3$ is equal to or later than the time when the temperature of the freezer compartment reaches the upper limit temperature $T_1$. Thus, the cooling operation of the refrigeration compartment is performed only once while the compressor is being driven.

According to a second embodiment of the disclosure, which is described below, if the temperature of the refrigeration compartment reaches the upper limit temperature $T_3$, the temperature of the refrigeration compartment is decreased to the lower limit temperature $T_4$ through the repeated opening/closing operations of the damper. Such operation delays when the temperature of the refrigeration compartment reaches the lower limit temperature. Accordingly, the damper is closed as the temperature of the refrigeration compartment reaches the lower limit temperature $T_4$, and it is possible to minimize the possibility that the temperature of the refrigeration compartment will be again increased to the upper limit temperature while the compressor is being driven to cool the freezer compartment. That is, the cooling operation of the refrigeration compartment is performed only once while the compressor is being driven.

Like with the first embodiment, the cooling operation of the refrigeration compartment of the second embodiment is performed only once while the compressor is being driven to cool the freezer compartment. However, unlike the first embodiment, which provides a control method for delaying the point of time when the temperature of the refrigeration compartment reaches the upper limit temperature T3 as late as possible, the second embodiment provides for a control method of delaying the point of time when the temperature of the refrigeration compartment reaches the lower limit temperature T4 as late as possible.

Figure 6:
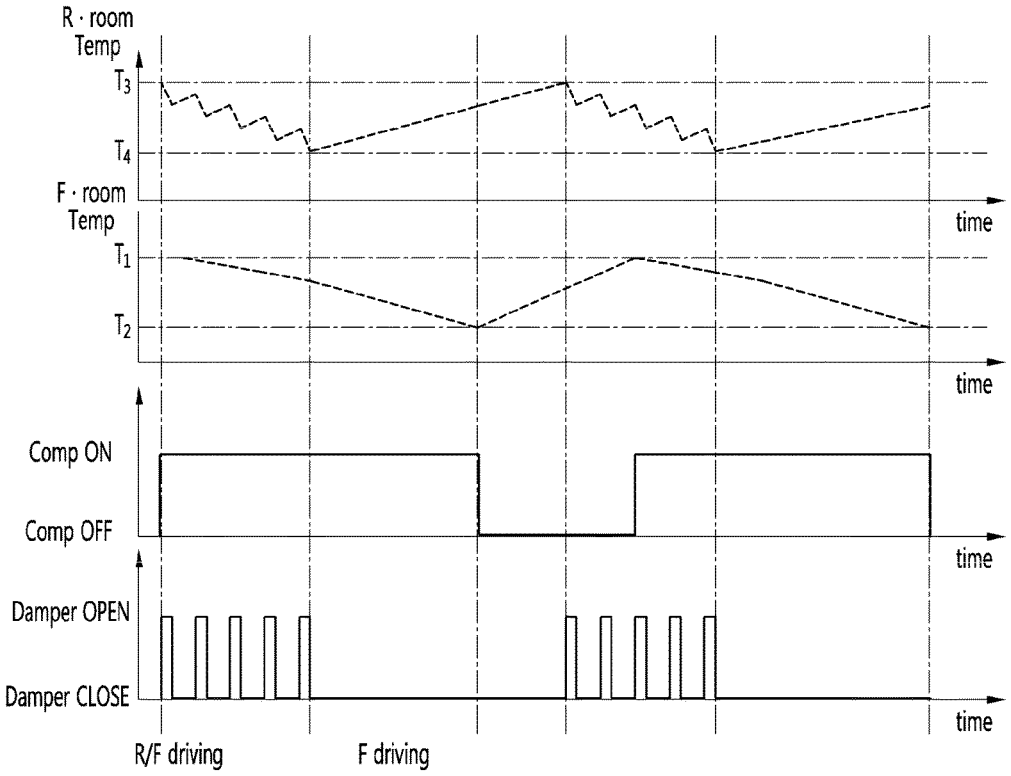
FIG. 6 is a graph illustrating a change in operation state of the refrigerator performed by a control method of the refrigerator according to a second embodiment of the disclosure.
Figure 7:
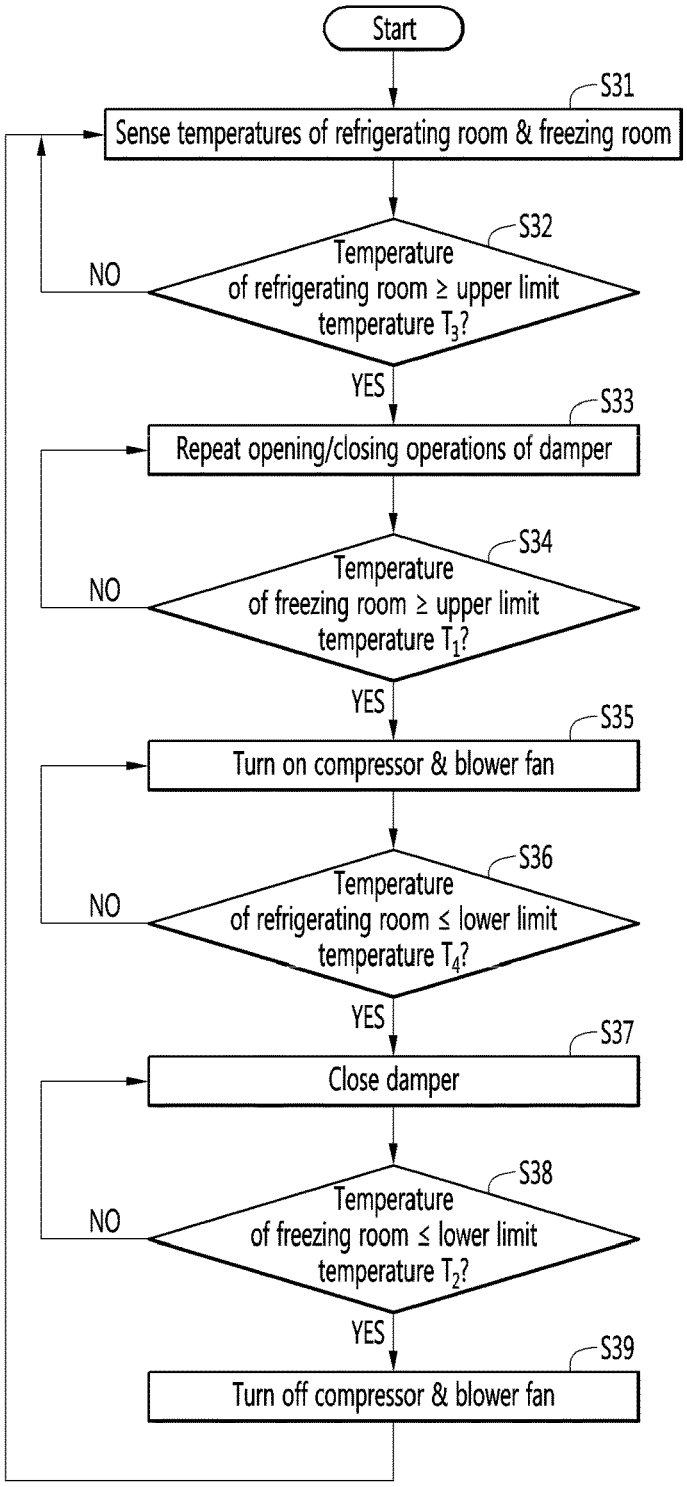
FIG. 7 is a flowchart illustrating the control method according to the second embodiment.

FIG. 6 is a graph illustrating a change in operation state of the refrigerator performed by a control method of the refrigerator according to a second embodiment of the disclosure. FIG. 7 is a flowchart illustrating the control method according to the second embodiment.

Referring to FIGS. 6 and 7, the refrigeration compartment temperature sensor 133 and the freezer compartment temperature sensor 123 sense temperatures of the refrigeration compartment 13 and the freezer compartment 12, respectively (S31).

Specifically, if it is determined that the sensed temperature of the refrigeration compartment 13 has reached the upper limit temperature $T_3$ (S32), the repeated opening/closing operations of the damper 40 are performed (S33). Then, if it is determined that the temperature of the freezer compartment 12 has reached the upper limit temperature T1 while the opening/closing operations of the damper 40 are being repeated (S34), the driving of the compressor 31 and the blower fan 122 is started (S35).

Here, when the cooling operation of the freezer compartment 12 is required as the temperature of the freezer compartment 12 reaches the upper limit temperature $T_1$ earlier than the temperature of the refrigeration compartment 13, the repeated opening/closing operations of the damper 40 may be performed together with the driving of the compressor 31 and the blower fan 122. That is, it is highly likely that a load will be increased at a temperature higher than the lower limit temperature $T_4$ even though the temperature of the refrigeration compartment 13 does not reach the upper limit temperature $T_3$, and therefore, the cooling operation of the refrigeration compartment 13 may be simultaneously performed when the cooling operation of the freezer compartment 12 is started. In addition, as the opening/closing operations of the damper 40 are periodically repeated, the point of time when the temperature of the refrigeration compartment 13 is cooled to the lower limit temperature $T_4$ may be delayed as late as possible.

Meanwhile, if it is determined that the temperature of the refrigeration compartment 13 has reached the lower limit temperature $T_4$ while the compressor 31 is being driven (S36), the damper 40 is closed (S37). Next, if it is determined that the temperature of the freezer compartment 12 has reached the lower limit temperature $T_2$ (S38), the driving of the compressor 31 and the blower fan 122 is stopped (S39).

Here, if there occurs a case where the cooling operation of the refrigeration compartment 13 is to be again performed before the driving of the compressor 31 is stopped, i.e., before the temperature of the freezer compartment reaches the lower limit temperature as the temperature of the refrigeration compartment 13 is again increased after the damper 40 is closed, the opening/closing period of the damper 40 may be adjusted such that the point of time when the temperature of the refrigeration compartment 13 is further delayed. For example, an opening/closing period in which the closing time of the damper 40 is set to be longer than the opening time of the damper 40 may be applied such that the point of time when the temperature of the refrigeration compartment 13 reaches the lower limit temperature is further delayed.

As described above, when the temperature of the refrigeration compartment 13 is increased to the upper limit temperature as the load of the refrigeration compartment 13 is increased, the damper 40 is periodically opened/closed, which delays the point of time when the temperature of the refrigeration compartment reaches the lower limit temperature. Accordingly, it is possible to prevent a situation in which the temperature of the refrigeration compartment 13 again reaches the upper limit temperature while the compressor 31 is being driven to cool the freezer compartment 12.

If the temperature of the refrigeration compartment 13 is again increased and then reaches the upper limit temperature $T_3$ while the compressor 31 is being driven, the driving time of the compressor 31 is increased to cool the refrigeration compartment 13, which delays the time when the cooling operation of the freezer compartment 12 is completed. Therefore, power consumption may be increased. The control method according to the second embodiment solves this problem, as described above.

The control method according to the embodiments of the present disclosure provides at least the following advantages.

First, in the state in which the driving of the compressor and the blower fan is stopped as the cooling operation of the freezer compartment is ended, the damper is periodically opened/closed, so that the cold air at the upper portion of the freezer compartment is supplied into the refrigeration compartment through the natural convection, thereby additionally cooling the refrigeration compartment. Accordingly, cold air is supplied into the refrigeration compartment before the cooling operation of the refrigeration compartment is performed, thereby suppressing an increase in the temperature of the refrigeration compartment. Further, when the cooling operation of the refrigeration compartment is performed, the time required to cool the refrigeration compartment to a set temperature is shortened, so that it is possible to improve the efficiency of the cooling operation of the refrigeration compartment.

Second, according to the above disclosed embodiments of the present disclosure, it is unlikely that the damper will be frozen while the damper is being periodically opened/closed, so the heater heating the damper can be turned off. As a result, it is possible to prevent cooling efficiency from being deteriorated due to the heating operation of the heater. Additionally, it is possible to reduce power consumption caused by the heating operation of the heater.

Third, according to the above disclosed embodiments of the present disclosure, cold air having a relatively low temperature may be distributed at the upper portion of the freezer compartment after the driving of the compressor and the blower fan is stopped. In this state, a portion of the cold air introduced into the freezer compartment through the opening of the damper may be directed toward the refrigeration compartment, so that it is possible to substantially equalize the entire temperature distribution of the freezer compartment.

Fourth, according to the above disclosed embodiments of the present disclosure, when the cooling operation of the refrigeration compartment is performed, the opening/closing operations of the damper may be periodically repeated, so that it is possible to delay the point of time when the cooling operation of the refrigeration compartment is ended. Thus, the cooling operation of the refrigeration compartment can be performed only once while the compressor is being driven. Additionally, cold air having a relatively high temperature in the refrigeration compartment may be prevented from being introduced into the freezer compartment, so that it is possible to shorten the cooling operation of the freezer compartment and the driving time of the compressor, thereby reducing power consumption.

Fifth, according to the above disclosed embodiments of the present disclosure, the cooling operation of the refrigeration compartment is performed before the cooling operation of the freezer compartment is ended. Thus, the opening/closing operations of the damper are periodically performed when a next cooling operation of the refrigeration compartment is performed, or the opening/closing period of the damper is adjusted, so that it is possible to delay the point of time when the cooling operation of the refrigeration compartment is ended. Thus, when no additional operation is performed for cooling the refrigeration compartment, the refrigeration compartment can be cooled at high speed, thereby improving cooling performance. Additionally, although an additional cooling operation of the refrigeration compartment is performed, a next cooling operation of the refrigeration compartment is controlled, so that it is possible to shorten the time required to perform the cooling operation of the freezer compartment. As a result, the driving time of the compressor can be shortened, thereby reducing power consumption.

Sixth, according to the above disclosed embodiments of the present disclosure, the opening/closing operations of the damper is periodically repeated in an early stage when the cooling operation of the refrigeration compartment is performed, so that it is possible to delay the point of time when the cooling operation of the refrigeration compartment is performed. As a result, the cooling operation of the refrigeration compartment can be performed only once while the compressor is being driven. Thus, it is possible to shorten the operation time of the freezer compartment and the driving time of the compressor. Accordingly, it is possible to reduce power consumption.

Although embodiments have been described with reference to a number of illustrative embodiments thereof, it is understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet forming a storage space;

a barrier partitioning the storage space into a refrigeration compartment and a freezer compartment, the barrier having a supply duct and a return duct formed at separate portions thereof to connect the refrigeration compartment with the freezer compartment;

a compressor compressing a refrigerant;

an evaporator cooling cold air in the storage space;

a blower fan supplying the cold air generated by the evaporator into the freezer compartment;

a damper that opens and closes the supply duct; and a controller controlling driving of the compressor, the blower fan, and the damper, wherein the controller controls the driving of the compressor and the blower fan to stop when temperatures of the refrigeration compartment and the freezer compartment are both in a satisfactory state, wherein when a set time elapses from a point of time when the driving of the compressor is stopped or when the temperature of the refrigeration compartment is increased to a set temperature between an upper limit temperature of the refrigeration compartment and a lower limit temperature of the refrigeration compartment, the controller controls the damper to repeat opening and closing operations at an interval of a predetermined time, up to a point of time when the compressor is to be driven as the temperature of the freezer compartment is in an unsatisfactory state, in order to delay a point of time when the temperature of the refrigeration compartment reaches the upper limit temperature as late as possible.

2. The refrigerator of claim 1, wherein, when the temperature of the freezer compartment reaches the upper limit temperature while the opening and closing operations of the damper are being repeatedly performed, the controller controls the compressor and the blower fan to be driven.

3. The refrigerator of claim 2, wherein, when the driving of the compressor and the blower fan are started, the damper is maintained in its opened state.

4. The refrigerator of claim 3, wherein, when the temperature of the refrigeration compartment reaches the lower limit temperature after the driving of the compressor and the blower fan is started, the damper is closed.

5. The refrigerator of claim 4, further comprising a heater to prevent freezing of the damper, wherein the heater is in a turn-on state while the damper is maintained in either its opened or closed state.

6. The refrigerator of claim 4, further comprising a heater to prevent freezing of the damper, wherein the heater is in a turn-off state while the opening and closing operations of the damper are being repeatedly performed.

7. The refrigerator of claim 1, further comprising a freezer compartment temperature sensor that senses a temperature of the freezer compartment, and a refrigeration compartment temperature sensor that senses a temperature of the refrigeration compartment, wherein the controller controls driving of the compressor and the damper based on temperatures respectively sensed by the freezer and refrigeration compartment temperature sensors to maintain the refrigeration and freezer compartments within a set temperature range.

8. A refrigerator comprising:

a cabinet forming a storage space;

a barrier partitioning the storage space into a refrigeration compartment and a freezer compartment, the barrier having a supply duct and a return duct formed at separate portions thereof to connect the refrigeration compartment with the freezer compartment;

a compressor compressing a refrigerant;

an evaporator cooling cold air in the storage space;

a blower fan supplying the cold air generated by the evaporator into the freezer compartment;

a damper opening and closing the supply duct; and a controller controlling driving of the compressor, the blower fan, and the damper, wherein, when a temperature of the refrigeration compartment reaches a first upper limit temperature, the controller controls the damper to repeat opening and closing operations at an interval of a predetermined time until the temperature of the refrigeration compartment reaches a first lower limit temperature in order to delay a point of time when the temperature of the refrigeration compartment reaches the first lower limit temperature as late as possible.

9. The refrigerator of claim 8, wherein the controller controls the damper to close when the temperature of the refrigeration compartment reaches the first lower limit temperature.

10. The refrigerator of claim 8, wherein the controller controls the driving of the compressor and the blower fan to start when the temperature of the freezer compartment reaches a second upper limit temperature which is different from the first upper limit temperature.

11. The refrigerator of claim 10, wherein the controller controls the driving of the compressor and the blower fan to stop when the temperature of the freezer compartment reaches a second lower limit temperature which is different from the first lower limit temperature.

12. The refrigerator of claim 11, wherein the controller adjusts the period in which the damper is opened and closed, when the temperature of the refrigeration compartment again reaches the first upper limit temperature before the driving of the compressor and the blower fan is stopped.

13. The refrigerator of claim 12, wherein, when the temperature of the refrigeration compartment again reaches the first upper limit temperature before the driving of the compressor and the blower fan is stopped, the controller adjusts the time that the damper is closed to be longer than the time that the damper is opened.

14. The refrigerator of claim 8, further comprising a freezer compartment temperature sensor that senses a temperature of the freezer compartment, and a refrigeration compartment temperature sensor that senses a temperature of the refrigeration compartment, wherein the controller controls driving of the compressor and the damper based on temperatures respectively sensed by the freezer and refrigeration compartment temperature sensors to maintain the refrigeration and freezer compartments within a set temperature range.

* * * * *